United States Patent [19]

Espenhahn et al.

[11] 4,347,115

[45] Aug. 31, 1982

[54] ELECTROPLATING APPARATUS

[75] Inventors: Manfred Espenhahn; Manfred Folwaczny, both of Essen, Fed. Rep. of Germany

[73] Assignee: Thyssen Aktiengesellschaft vorm. August Thyssen-Hütte, Duisburg, Fed. Rep. of Germany

[21] Appl. No.: 259,721

[22] Filed: May 1, 1981

[30] Foreign Application Priority Data

May 3, 1980 [DE] Fed. Rep. of Germany ..... 3017079

[51] Int. Cl.[3] ..... C25D 17/00; C25D 17/10

[52] U.S. Cl. ..... 204/206; 204/211

[58] Field of Search ..... 204/206, 28, 43 Z, 237, 204/49, 285, 205, 702, 211

[56] References Cited

U.S. PATENT DOCUMENTS 2,723,953 11/1955 Burgemeister ..... 204/211
3,954,571 5/1976 Eppensteiner et al. ..... 204/206 X
3,989,604 11/1976 Austin ..... 204/206 X
4,183,799 1/1980 Sellitto et al. ..... 204/206
4,282,073 8/1981 Hirt et al. ..... 204/28

*Primary Examiner*—T. M. Tufariello
*Attorney, Agent, or Firm*—Sprung, Horn, Kramer & Woods

[57] ABSTRACT

An apparatus is disclosed for the electroplating of metal strips, and more particularly for the zinc-coating of steel strip, which comprises a tank filled with electrolyte liquid and immersed therein, at least one anode which is disposed above a strip to be electrolytically coated and at least one anode disposed below said strip, both of said anodes being parallel to said strip. The anode disposed above the strip is electrolytically consumable and made of an electrolytically depositable metal for deposition on said strip and the anode disposed below the strip consists essentially of a material that is insoluble in the electrolyte and not electrolytically consumable. Each anode is connected to a source of current, the anode disposed below said strip being provided with means for disconnecting it from said source of current.

9 Claims, 2 Drawing Figures

ELECTROPLATING APPARATUS

BACKGROUND OF THE INVENTION

The invention relates to an apparatus for the electroplating of metal strips, and more particularly for the zinc-coating of steel strip, which comprises a tank that is filled with electrolytic liquid which, in particular, flows therethrough; at least one electrode disposed above the strip; and at least one electrode disposed below the strip, both being parallel thereto and immersed in the electrolytic liquid.

In a known apparatus of this type (German Pat. No. 689,548), an electrode made of the metal to be deposited is provided only on the side of the strip which it is desired to coat; and when both sides of the strip are to be coated, electrodes made of the metal to be deposited are disposed on both sides of the strip. The depositable metal of the electrode is consumed in the course of the electroplating operation, and as a result of the attendant change in the distance between the side of the strip being coated and the electrode the electric field changes. Thus there is no assurance that electroplating will be uniform over the entire length of the strip. If more or less uniform electroplating were to be secured with this apparatus, the electrodes would have to be replaced at regular intervals. Now such replacement, especially of the electrode located below the strip, is difficult and time-consuming and requires that the apparatus be shut down.

Difficulties of this type have not been encountered with an earlier apparatus which has again been attracting attention of late. (German Pat. No. 250,403; Stahl und Eisen 92 [1972], No. 18, page 833.) In that apparatus the anode is formed of an insoluble metal, which means that the initial spacing remains unchanged even during extended operation. However, to avoid a drop in the ion transport, necessary to electroplating, in the electrolyte, the electrolytic liquid must be worked up in separate, additional equipment in such a way that it contains ions of the metal to be deposited in sufficient concentration. In other words, in this apparatus the electrolyte must be continuously recirculated between the coating apparatus and the working-up equipment.

SUMMARY OF THE INVENTION

The object of the invention is to provide an electroplating apparatus which is of simple construction and makes it possible to coat the strip either on one side or on both sides without a time-consuming changeover.

In accordance with the invention, this object is accomplished in that the electrode disposed above the strip is formed of the metal to be deposited, for example, zinc, and that the electrode disposed below the strip consists of a material that is insoluble in the electrolyte and is disconnectable from the current source for the purpose of one-sided electroplating.

In the apparatus in accordance with the invention, the ions necessary for coating are supplied by the consumable electrode disposed above the strip, both in one-sided and in two-sided coating. The costly working up of the electrolyte in separate equipment and the recirculating which requires additional energy are dispensed with in the apparatus of the invention. Since the electrode disposed below the strip, which is accessible only with difficulty, consists of a material that is not soluble in the electrolyte, its spacing from the strip remains unchanged, and uniform coating is therefore assured.

The apparatus in accordance with the invention offers a further advantage in one-sided electroplating when the lower electrode is disconnected from the current source. The current supply provided for the lower electrode can then serve as an additional current source for the upper electrode. Because of the doubled current, the coating operation can then be performed more rapidly.

In accordance with one feature of the invention, the upper and/or lower electrode is or are adjustable with respect to its or their spacing from the strip. The adjustability of the upper electrode, which is consumed in operation, is of particular importance. When the upper electrode is held at a constand distance from the strip, the voltage initially selected can be maintained. Special voltage-regulation means then are not needed. Since only the readily accessible upper electrode is consumed, replacing it will not take much time.

In electroplating apparatuses provided both above and below the strip to be coated with soluble electrodes made of the coating metal, it has been found that some slight coating of one side of the strip will occur even when the electrode associated with that side of the strip is not connected to the voltage source. For satisfactory one-sided coating, it is therefore necessary in such apparatus to remove the electrode associated with the side of the strip that is not to be coated from the electrolyte. With the apparatus in accordance with the invention, no such changeover is necessary. Merely disconnecting the nonconsumable electrode will leave the side of the strip facing that electrode uncoated. On the other hand, it is also possible to lower that electrode sufficiently that it will not have any effect on the side of the strip facing it even when voltage is still being applied to it.

In apparatuses in which strips of different widths are to be handled, difficulties arise from the fact that the electrodes in essence are consumed only over the areas covered by the strip. When such apparatus is subsequently used to coat a wide strip, the coating will be thicker along the edges of the strip because the spacing between electrode and strip varies over the width of the strip. In accordance with a further feature of the invention, these drawbacks are avoided by dividing both the soluble electrode disposed above the strip and the insoluble electrode disposed below the strip into segments which extend parallel to the edges of the strip and which can be connected to the current source as desired on the basis of the width of the strip to be coated. This arrangement is of advantage also in one-sided electroplating. By disconnecting the marginal regions of the electrodes, the spreading of the electric field onto the side of the strip facing away from the electrode, and hence the unintentional coating of that side, can be effectively prevented.

Moreover, a slight spreading of the electric field around the edges of the strip and the attendant slight coating of the side of the strip which faces away from the electrode can be prevented by providing shielding masks which extend parallel to the edges of the strip and to which a voltage may be applied, if desired, to build up a protective field.

However, the risk that the electric field may spread around the edges of the strip can be reduced or excluded also by connecting the outer segments to a voltage of opposite polarity.

Although with the apparatus in accordance with the invention there is no need to circulate the electrolyte between working-up equipment and the electrolyte-filled tank, it is advisable to circulate the electrolyte within the tank and to direct it by means of nozzles to the desired areas between the strip and the electrode in order to secure in those areas as uniform an ion concentration as possible.

In accordance with a further feature of the invention, a plurality of upper and lower electrodes is disposed in a row in the tank. However, it is also possible to use more than one tank. In that case, the distance between the points where the strip is guided will be less, and the strip will therefore be maintained more nearly at the desired spacing from the electrodes.

BRIEF DESCRIPTION OF THE DRAWINGS

The invention will now be described in greater detail with reference to the accompanying drawing, which illustrates an embodiment and wherein.

DETAILED DESCRIPTION OF THE INVENTION

Figure 1:
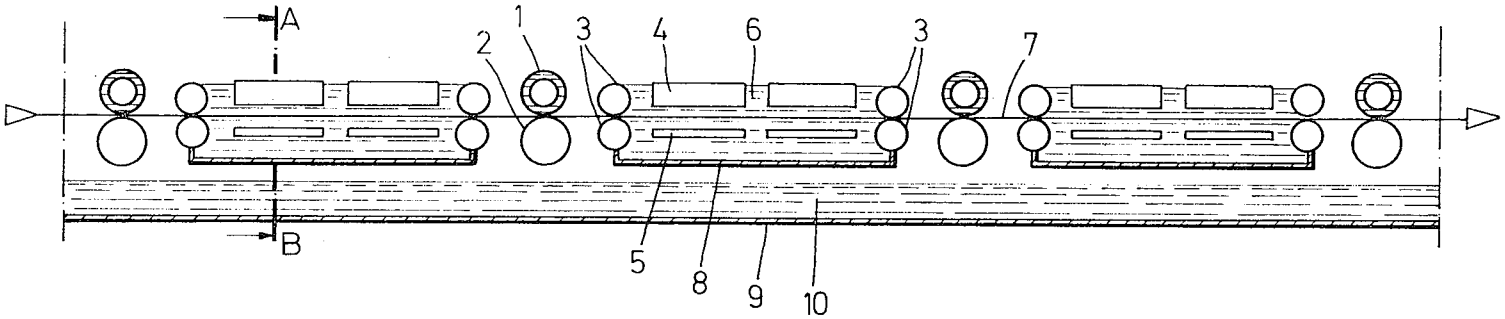
FIG. 1 is a diagrammatic side elevation of an apparatus for the electroplating of metal strips.

Disposed in a row above a catch basin 9 for electrolyte liquid 10 are several electroplating apparatuses. Each comprises a current roller 1 through which current can be supplied to a strip 7 which is to be coated; a pressure roller 2 disposed below the current roller 1; and a tank 8 which is filled with electrolyte 6 and at whose front and rear edges sealing rollers 3 are disposed between which the strip 7 enters and leaves the tank 8. In each tank 8, two electrodes 5 made of a material that is insoluble in the electrolyte, for example, titanium, carbon or lead-lined copper plates, are disposed below the strip 7 and parallel thereto, and above the strip 7 and parallel thereto two electrodes 4 made of a soluble material such as zinc. The other terminal of the current source is connected to the electrodes 4 and 5, the electrodes 5 being disconnectable as desired.

Figure 2:
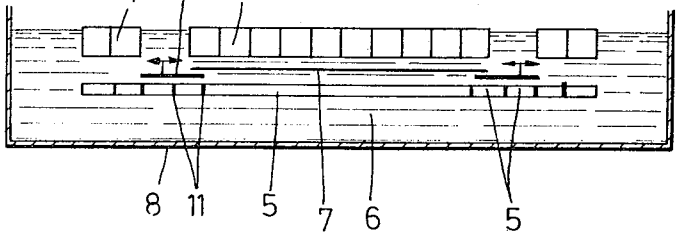
FIG. 2 is a sectional view of the apparatus of FIG. 1, taken along the line A—A.

As is apparent from FIG. 2, the upper and lower electrodes 4 and 5 are formed of a plurality of segments, especially in the marginal zones. The segments of the upper electrode 4 may be spaced apart while the segments of the lower electrode 5 are separated from one another by insulating strips 11. The segments of the electrodes 4 and 5 may be connected to the current source as desired. Disposed between the strip 7 and the lower electrode 5 are, in the marginal zone, masks 12 adapted to be displaced horizontally and vertically relative to the edges.

The electrolyte can be circulated into the space or spaces between the active electrode 4 and 5 or 4 and the strip 7 to be coated so that there is a uniform ion concentration in that area.

What is claimed is:

1. An apparatus for the electroplating of metal strips, and more particularly for the zinc-coating of steel strip, which comprises a tank that is filled with electrolyte liquid, and, immersed therein, at least one anode disposed above a strip to be electrolytically coated and at least one anode disposed below said strip, both of said anodes being parallel to said strip, the anode (4) disposed above the strip (7) being electrolytically consumable and made of an electrolytically depositable metal for deposition on said strip, and the anode (5) disposed below said strip (7) consisting essentially of a material that is insoluble in the electrolyte and not electrolytically consumable, each of said anodes being connected to a source of current, said anode (5) disposed below said strip being provided with means for disconnecting the same from said source of current.

2. An apparatus according to claim 1, wherein the upper and/or lower anode (4,5) is or are provided with means for adjusting its or their spacing from the strip.

3. An apparatus according to claim 1, wherein said anodes (4,5) are divided into several segments extending parallel to the edges of the strip, said segments being provided with means to connect the same to the current source independently of one another.

4. An apparatus according to claim 1, wherein there are associated with the anodes (4,5), parallel to the edges of the strip to be coated, shielding masks to contain the electric field.

5. An apparatus according to claim 3 wherein the outer segment or segments is or are provided with a means to connect it or them to a voltage whose polarity is the opposite of that of the voltage of the remainder of the anode.

6. An apparatus according to claim 1 wherein at least one pump is provided for circulation of the electrolyte, as well as nozzles for establishing the direction of flow.

7. An apparatus according to claim 1 wherein a plurality of anodes is disposed in a row above and below the strip.

8. An apparatus according to claim 1 wherein said anode disposed above said strip comprises zinc.

9. An apparatus according to claim 1 wherein said anode of insoluble material comprises titanium, carbon or lead-lined copper plates.

* * * * *